US006520438B2

(12) United States Patent
Van Mullem

(10) Patent No.: US 6,520,438 B2
(45) Date of Patent: Feb. 18, 2003

(54) GYRATORY CRUSHER MAINSHAFT

(75) Inventor: Albert J. Van Mullem, Sussex, WI (US)

(73) Assignee: Sandvik AB, Sandviken (SE)

( * ) Notice: Subject to any disclaimer, the term of this patent is extended or adjusted under 35 U.S.C. 154(b) by 1 day.

(21) Appl. No.: 09/754,992

(22) Filed: Jan. 5, 2001

(65) Prior Publication Data

US 2002/0088883 A1 Jul. 11, 2002

(51) Int. Cl.[7] ..... B02C 2/00
(52) U.S. Cl. ..... 241/210
(58) Field of Search ..... 241/207–216

(56) References Cited

U.S. PATENT DOCUMENTS

| | | | |
|---|---|---|---|
| 3,924,815 | A | 12/1975 | Haggren |
| 4,179,076 | A | 12/1979 | Barrot et al. |
| 4,384,684 | A | 5/1983 | Karra |
| 4,410,143 | A | 10/1983 | Polinski |
| 4,467,971 | A | 8/1984 | Schuman |
| 4,478,373 | A | 10/1984 | Gieschen |
| 4,519,551 | A | 5/1985 | Ceurvorst |
| 4,659,026 | A | 4/1987 | Krause et al. |
| 4,750,679 | A | 6/1988 | Karra et al. |
| 5,022,593 | A | 6/1991 | Stelk |
| 5,031,843 | A | 7/1991 | Motz |
| 5,080,294 | A | 1/1992 | Dean |
| 5,372,318 | A | 12/1994 | Jacobson |
| 5,769,340 | A | 6/1998 | Jean |
| 5,775,607 | A | 7/1998 | Bayliss et al. |
| 5,803,382 | A | 9/1998 | Ganser, IV et al. |
| 5,810,269 | A | 9/1998 | Shannon |
| 5,915,638 | A | 6/1999 | Jean |
| 5,934,583 | A | 8/1999 | Jean |
| 5,938,133 | A | 8/1999 | Bayliss et al. |
| 5,944,265 | A | 8/1999 | Ganser, IV et al. |
| 5,964,422 | A | 10/1999 | Ruokonen et al. |
| 5,996,916 | A | 12/1999 | Musil |
| 6,007,009 | A | 12/1999 | Sheridan et al. |

*Primary Examiner*—Mark Rosenbaum
(74) *Attorney, Agent, or Firm*—Burns, Doane, Swecker & Mathis, LLP

(57) ABSTRACT

A gyratory crusher uses a new head nut attachment apparatus. The gyratory crusher has a shell, a shaft disposed within the shell, a mantle covering a portion of the shaft, a head nut located above the mantle, and a sleeve between the head nut and the shaft. The sleeve is maintained in position on the shaft by means of a tapered contact surface between the sleeve and the shaft, and the head nut is threaded onto the sleeve.

26 Claims, 2 Drawing Sheets

GYRATORY CRUSHER MAINSHAFT

FIELD OF THE INVENTION

This invention relates to rock crushing systems, such as conical rock crushers or gyratory crushers. Specifically, this invention elates to the main shaft assembly and head nut system.

BACKGROUND OF THE INVENTION

Gyratory rock crushers generally have a downwardly expanding central conical member which rotates or gyrates within an outer upwardly expanding frustroconically shaped member typically called a shell. The shell can be comprised of two or more pieces, e.g., a top shell and a bottom shell. The central conical member generally has a wearing cover or a liner called a mantle. A spider assembly rests on the top shell, forming the top of the support structure for the machine.

A shaft extends vertically through the rock crusher. This shaft is supported by a bearing in the spider assembly. The central portion of the shaft tapers inwardly in an upward direction to form the central conical crushing member. This portion of the shaft supports the mantle, which moves with the shaft to effect the crushing operation. The spider assembly is designed to support the shaft while allowing gyratory movement during operation of the machine. Additionally, the vertical position of the shaft is controlled by a piston arrangement in the spider.

A head nut, attached to a sleeve disposed about the shaft is used to retain the mantle in place. The head nut resists upward forces from the mantle, which tends to move in an upward direction during crusher operation. The head nut is also subject to wear from the operation of the machine, as well as damage from impacts due to the rocks being dumped into the machine from above. The head nut is disposable, but the threads used to secure the head nut to the shaft may become damaged as well. If the threads are stressed out of shape due to operation, suffer fatigue failures such as cracking of the threads, or are damaged due to impacts from falling material on the head nut, repairs can be expensive. Repairing damaged threads on the shaft may include removing the shaft from the machine to be refurbished. The repair operation is costly both because of the cost of reworking the shaft as well as the cost of machine down time while the shaft is being repaired. Accordingly, the crushing system is designed so that the shaft of the crusher is preserved from being repaired in favor of other components which may be more easily repaired or replaced, such as a sleeve.

A design that does not require threads on the shaft results in a smooth shaft with a resultant lower incidence of failure. Sleeves are sometimes used between the shaft and the head nut to avoid the use of threads directly on the shaft, but the sleeves may require complicated arrangements to be secured in a vertical direction with respect to the shaft. Also, split sleeves that are sometimes used require fasteners for installation. Preferably, the sleeve and head nut are compact and replaceable in case of damage or maintenance needs. The presence of additional fasteners on the sleeve or head nut complicates assembly, removal, and maintenance.

Therefore, it would be advantageous to have a sleeve and head nut arrangement that does not require threads on the shaft. Further, there is a need for a head nut assembly that is self-tightening in response to upward loads. Further still, there is a need for a compact and easily replaceable sleeve and head nut arrangement that does not require additional fasteners.

SUMMARY OF THE INVENTION

An exemplary embodiment relates to an attachment apparatus for a gyratory crusher including a shaft and a mantle disposed about the shaft. The attachment apparatus has a sleeve disposed about the shaft defining a contact surface between the sleeve and the shaft and a head nut threaded onto the sleeve. The radius of the shaft increases in an upward direction over at least part of the contact surface, whereby the head nut retains the mantle with respect to the shaft in at least one direction.

Another embodiment relates to an attachment apparatus for a gyratory crusher including a shaft and a mantle disposed about the shaft. The attachment apparatus has a sleeve disposed about the shaft and a head nut threaded onto the sleeve. The sleeve is a continuous ring, whereby the head nut prevents upward motion of the mantle.

Still another embodiment relates to a gyratory crusher having a shell, a shaft disposed within the shell, a mantle covering a portion of the shaft, a head nut located above the mantle, and a sleeve between the head nut and the shaft. The sleeve is maintained and positioned on the shaft by means of a tapered contact surface between the sleeve and the shaft.

A still further embodiment relates to a method of assembling or repairing a gyratory crusher. This method includes heating a sleeve, placing the sleeve over a shaft, cooling the sleeve to effect a shrink fit arrangement on the shaft, and threading a head nut onto the sleeve.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
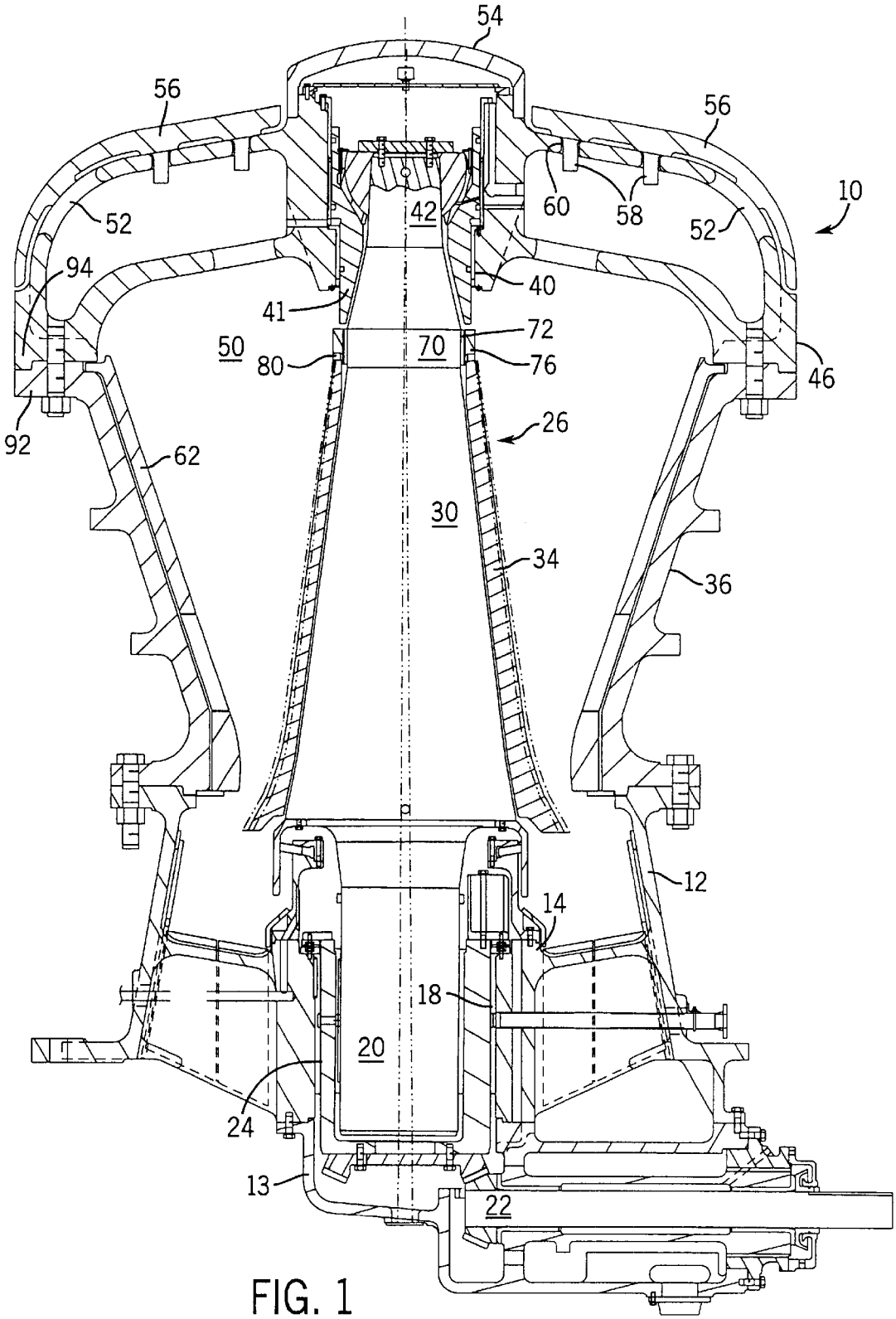
FIG. 1 is a vertical cross-sectional view of the gyratory crusher.

Referring to FIG. 1, a gyratory crusher 10 can be utilized to crush rock, ore, minerals, waste, or other material. Gyratory crusher 10 is assembled on a cast steel base or bottom shell 12 having a central hub 14. Central hub 14 is provided with a vertical bore 18 adapted to receive a cylindrical support shaft 20. This shaft 20 varies in cross section, but extends through the machine into the spider 46. Drive housing 13 extends outwardly from hub 14 to enclose a drive mechanism 22. Drive mechanism 22 causes rotation of an eccentric 24 which directs the gyratory motion of the shaft 20.

A head assembly 26, which is part of the shaft 20, includes a head member 30 which is covered by a mantle 34. Mantle 34 provides one of the crushing surfaces of crusher 10. At an upper portion of the head member 30, above the mantle 34, the shaft 20 has an outwardly tapered segment 70. A sleeve 72 surrounds this outwardly tapered segment 70 and a head nut 76 is threaded onto the sleeve 72. The head nut 76 resists the upward force of the mantle 34 at an interface 80 between the two components.

A top shell 36 projects upwardly from bottom shell 12 and is covered by a spider assembly including a spider 46. Alternatively, top shell 36 and bottom shell 12 can be a single piece component. Spider 46 includes an aperture 40 that receives a piston 41 and an end 42 of shaft 20.

Top shell 36 is protected from wear by several rows of concaves 62. These concaves 62 provide the crushing surface opposing mantle 34. Spider 46 can be attached or rest upon top shell 36. Preferably top shell 36 includes a recessed portion 92 for receiving a flange 94 of spider 46. Vertical positioning of shaft 20 with respect to top shell 36 adjusts the relative position of concaves 62 with respect to the mantle 34 of the head member 30, thereby adjusting the size of the crushed material exiting crusher 10.

Material to be crushed is supplied through spider 46 which includes openings (not shown) for entry of the material into crushing cavity 50. A liquid flush apparatus (not shown) may be provided for spraying a liquid such as water toward the crusher cavity 50.

The spider 46 is comprised of spider arms 52 radially extending outward from the center to a spider rim (not shown). A spider cap 54 sits on the top center of the spider 46. Each of the spider arms 52 is protected from falling material by a spider arm guard 56. The spider rim is protected by a rim liner (not shown), also known as a hopper liner.

Figure 2:
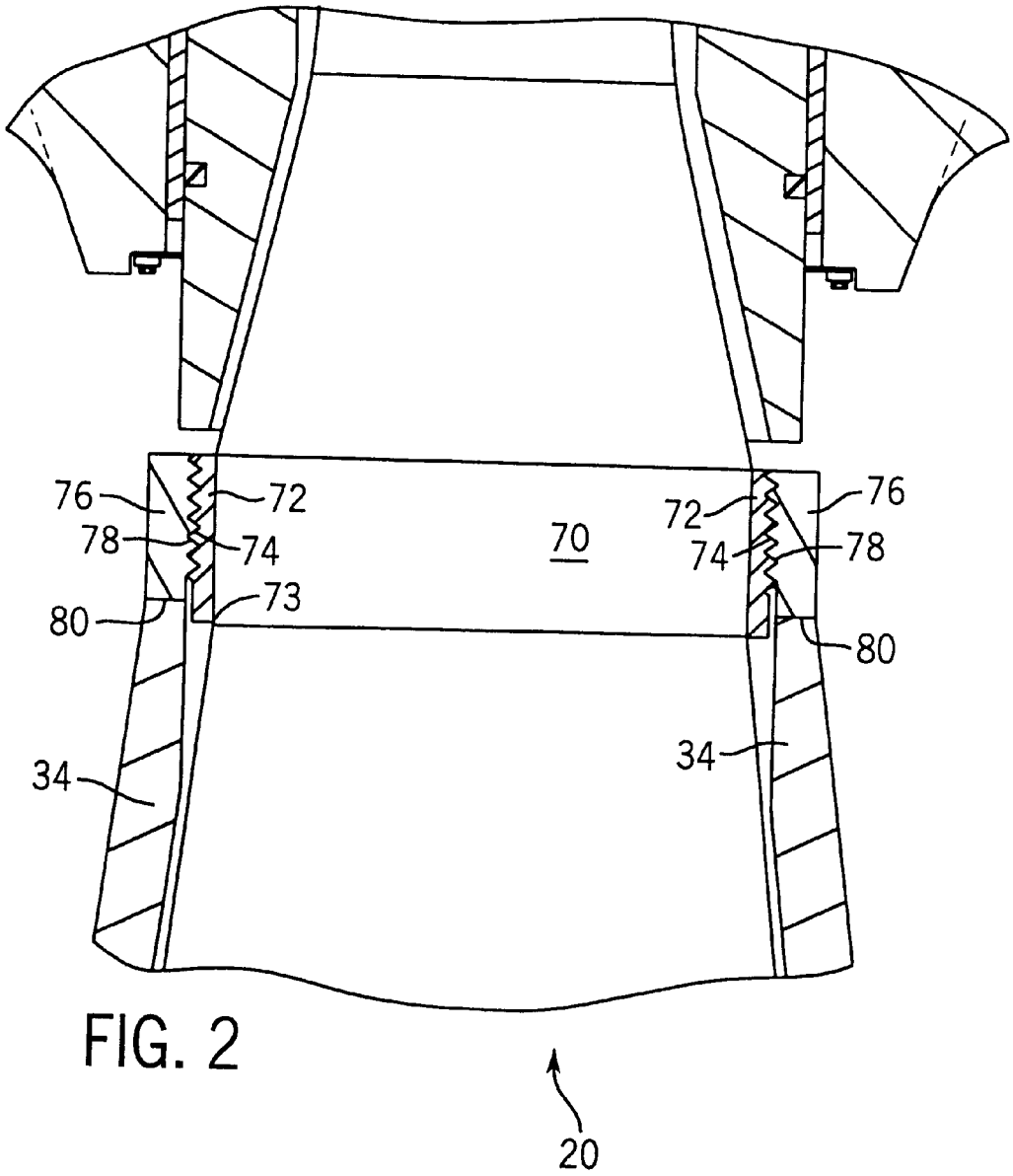
FIG. 2 is a partial vertical cross-sectional view of a portion of the gyratory crusher shaft.

Referring now to FIG. 2, the structure associated with the sleeve 72 and head nut 76 is shown. The mantle 34 has a tendency to move upward during crusher operation. Thus, the head nut 76 is used to retain the mantle 34 in place. In turn, the head nut must be secured vertically with respect to the shaft 20. To accomplish this, a sleeve 72 is fixed to segment 70 of the shaft 20, and the head nut 76 is attached to the sleeve 72. In a preferred embodiment, the head nut 76 is located about 40 inches from top of shaft 20, and is concentric with the outside diameter of the sleeve 72.

In a preferred embodiment, the segment 70 begins at a point 73, located about 47 inches from top of the shaft 20. This shaft 20 increases in diameter in an upward direction in segment 70, a taper of 1:315 from vertical. This is in contrast to the inward taper of the shaft 20 below the upper segment 70 of 1:8.2. The inner diameter of the sleeve 72 matches the 1:315 taper, and therefore is prevented from moving in an upward direction by the increasing diameter. The sleeve 72 is heated and shrunk onto the shaft 20 so no further fastening means are required. The fit between the sleeve 72 and segment 70 is snug once the sleeve 72 is shrunk onto segment 70. Alternatively, the sleeve 72 could have a V-shaped inner wall, fitting into a corresponding shape on segment 70.

In a preferred embodiment, the sleeve 72 is a ring that at the top portion has an inner diameter of 25.00 inches and an outer diameter of 26.9 inches and at the bottom portion has an inner diameter of 24.95 inches and an outer diameter of 26.9 inches. This creates the taper of 1:315 from vertical. The exterior of the sleeve 72 has sleeve threads 74. The threads 74 are American National-Right Hand 0.5 inch pitch. The sleeve 72 is made of steel. The inner surface of the sleeve 72 is a smooth fit with segment 70.

The head nut 76 retains the mantle 34 from moving upward during crusher operation by direct resistance at an interface 80 between the two components. The head nut 76 is made of steel and is threaded onto the sleeve 72. Thus, the head nut 76 has threads 78 matching the sleeve threads 74. The outer diameter of the head nut 76 is 31.3 inches in a preferred embodiment. Because the head nut 76 is threaded onto the sleeve 72 rather than the shaft 20, the upward load is transmitted through the threads to the sleeve 72, removing stress concentrations from the shaft 20 because the shaft 20 does not have threads. Additionally, if the upward load causes damage to the sleeve threads 74 or head nut threads 78 or either one of those members 72 or 76, those parts may be more easily repaired or replaced than the shaft 20.

The sleeve 72 requires no fasteners for installation because it is heat shrunk onto the shaft as one continuous ring. Additionally, because of the reverse taper of segment 70, the sleeve 72 and head nut 76 arrangement is self-tightening in responds to upward loads from the mantle 34. Also, the reverse taper structure removes the necessity of having additional structural members above the sleeve 72 or head nut 76 to retain those members in a stable vertical position with respect to the shaft 20.

The gyratory crusher 10 operates as follows. When the drive mechanism 22 is driven by any appropriate means, it transmits power to the eccentric 24. The eccentric 24 causes the gyration of the head assembly 26, resulting in the crushing of the material in the crushing chamber 50. The phantom lines flanking the mantle and center axis on FIG. 1 indicate the range of gyratory motion.

The above arrangement solves the long-standing problems discussed in the Background of the Invention section because the shrink fit of the sleeve 72 onto segment 70 allows a smooth exterior surface of the shaft 20 rather than the use of threads. The reverse taper of segment 70 and sleeve 72 resists vertical displacement of the sleeve 72 and head nut 76 in response to mantle 34 upward loads. The sleeve 72 and head nut 76 are both easily replaceable, especially because no fasteners are required to attach the sleeve 72 to the shaft 20. Also because of the reverse taper, no further structure is required to maintain the sleeve 72 in position with respect to the shaft 20.

While several embodiments of the invention have been described, it should be apparent to those skilled in the art that what has been described is considered at present to be the preferred embodiments of a sleeve 72 and head nut 76 arrangement and method of installation. However, in accordance with the patent statutes, changes may be made in the design without actually departing from the true spirit and scope of this invention. The following claims are intended to cover all such changes and modifications which fall within the true spirit and scope of this invention.

What is claimed is:

1. An attachment apparatus in combination with a gyratory crusher including a shaft and a mantle disposed about the shaft, the attachment apparatus comprising:

a sleeve disposed about the shaft defining a contact surface between the sleeve and the shaft; and a head nut threaded onto the sleeve;

wherein the radius of the shaft increases in an upward direction over at least part of the contact surface, whereby the head nut retains the mantle with respect to the shaft in at least one direction.

2. The attachment apparatus of claim 1 wherein the sleeve is made of steel.

3. The attachment apparatus of claim 1 wherein the sleeve is fixed to the shaft by means of a shrink fit.

4. The attachment apparatus of claim 1 wherein the sleeve is a single piece ring.

5. The attachment apparatus of claim 4 wherein the sleeve has an upper end, and a lower end, the upper end having an inner diameter of 25.00 inches, and the lower end having an inner diameter of 24.95 inches.

6. The attachment apparatus of claim 1 wherein the contact surface has a 1:315 taper from vertical.

7. The attachment apparatus of claim 1 wherein the head nut has an inner diameter of about 26 inches and an outer diameter of about 31 inches.

8. The attachment apparatus of claim 1 wherein the contact surface extends about eight inches.

9. The attachment apparatus of claim 1 wherein the sleeve is disposed directly above the mantle.

10. An attachment apparatus in combination with a gyratory crusher including a shaft and a mantle disposed about the shaft, the attachment apparatus comprising:

a sleeve disposed about the shaft; and a head nut threaded onto the sleeve;

wherein the sleeve is a continuous ring, whereby the head nut prevents upward motion of the mantle.

11. The attachment apparatus of claim 10, further comprising:

a contact surface between the sleeve and the shaft;

wherein the shaft is tapered outwardly in an upward direction over at least part of the contact surface.

12. The attachment apparatus of claim 10 wherein the sleeve is made of steel.

13. The attachment apparatus of claim 10 wherein the sleeve is releasably secured to the shaft by using a heat shrink method.

14. The attachment apparatus of claim 11 wherein the contact surface has a 1:315 taper from vertical.

15. The attachment apparatus of claim 10 wherein the head nut has an inner diameter of about 26 inches and an outer diameter of about 31 inches.

16. The attachment apparatus of claim 11 wherein the contact surface extends about eight inches.

17. The attachment apparatus of claim 10 wherein the sleeve is disposed at a position directly above the mantle.

18. A gyratory crusher, comprising:

a shell;

a shaft disposed within the shell;

a mantle covering a portion of the shaft;

a head nut located above the mantle; and a sleeve between the head nut and the shaft;

wherein the sleeve is maintained in position on the shaft by means of a tapered contact surface between the sleeve and the shaft.

19. The gyratory crusher of claim 18 wherein the sleeve is made of steel.

20. The gyratory crusher of claim 18 wherein the sleeve is a continuous ring of material.

21. The gyratory crusher of claim 18 wherein the head nut is threaded onto the sleeve.

22. The gyratory crusher of claim 18 wherein the sleeve is affixed to the shaft by means of a shrink fit.

23. The gyratory crusher of claim 18 wherein the shaft has a smooth surface in the range of the contact surface.

24. The gyratory crusher of claim 18 wherein the contact surface has a 1:315 taper from vertical.

25. The gyratory crusher of claim 18 wherein the head nut has an inner diameter of about 26 inches and an outer diameter of about 31 inches.

26. The gyratory crusher of claim 18 wherein the contact surface extends about eight inches.

* * * * *